United States Patent [19]

Mennesson

[11] 3,934,571

[45] Jan. 27, 1976

[54] CARBURETORS FOR INTERNAL COMBUSTION ENGINES, WITH AN AUXILIARY STARTING DEVICE

[75] Inventor: Francois Mennesson, Nanterre, France

[73] Assignee: Societe Industrielle de Brevets et d'Etudes, Neuilly-sur-Seine, France

[22] Filed: Mar. 30, 1973

[21] Appl. No.: 346,477

[30] Foreign Application Priority Data

Apr. 10, 1972 France ..... 72.12543

[52] U.S. Cl. ..... 123/179 G; 123/119 F; 123/180 R; 261/39 A

[51] Int. Cl.[2] ..... F02M 1/16

[58] Field of Search..... 123/179 G, 180 R, 179 A, 123/180 T, 119 F; 261/39 A, 39 D, 39 B

[56] References Cited

UNITED STATES PATENTS

| | | | |
|---|---|---|---|
| 2,323,222 | 6/1943 | Holley et al. | 123/180 R X |
| 3,291,462 | 12/1966 | Mennesson | 123/180 T |
| 3,587,553 | 6/1971 | Sutton | 123/179 G X |

FOREIGN PATENTS OR APPLICATIONS

| | | | |
|---|---|---|---|
| 464,760 | 4/1937 | United Kingdom | 261/46 |
| 1,281,750 | 10/1968 | Germany | 123/179 G |
| 956,890 | 4/1964 | United Kingdom | 123/179 G |
| 122,859 | 2/1919 | United Kingdom | 123/180 R |
| 118,060 | 8/1918 | United Kingdom | 123/180 |

*Primary Examiner*—Wendell E. Burns
*Assistant Examiner*—David D. Reynolds
*Attorney, Agent, or Firm*—Stevens, Davis, Miller & Mosher

[57] ABSTRACT

The carburetor has a principal fuel jetting system which is situated upstream of a principal throttle member actuated by the operator and, for cold starting, an auxiliary starting device, controlled by the engine temperature, to increase the flow-rate of fuel and if necessary the flow-rate of air admitted into the intake pipe of the engine with respect to the flow-rate corresponding to hot idling. The starting device comprises a closure valve means adapted, as long as the engine has not reached its normal operating temperature, to open a channel which receives a mixture of air and of fuel in a well-determined proportion and which opens into the zone of the intake pipe situated downstream of its principal throttle member. A starting valve situated in the intake pipe upstream of the principal jetting system, is maintained sufficiently open, when the engine is warm, not to substantially enrich the air/fuel mixture on idling and at very small engine loads.

5 Claims, 3 Drawing Figures

CARBURETORS FOR INTERNAL COMBUSTION ENGINES, WITH AN AUXILIARY STARTING DEVICE

Figure 1:
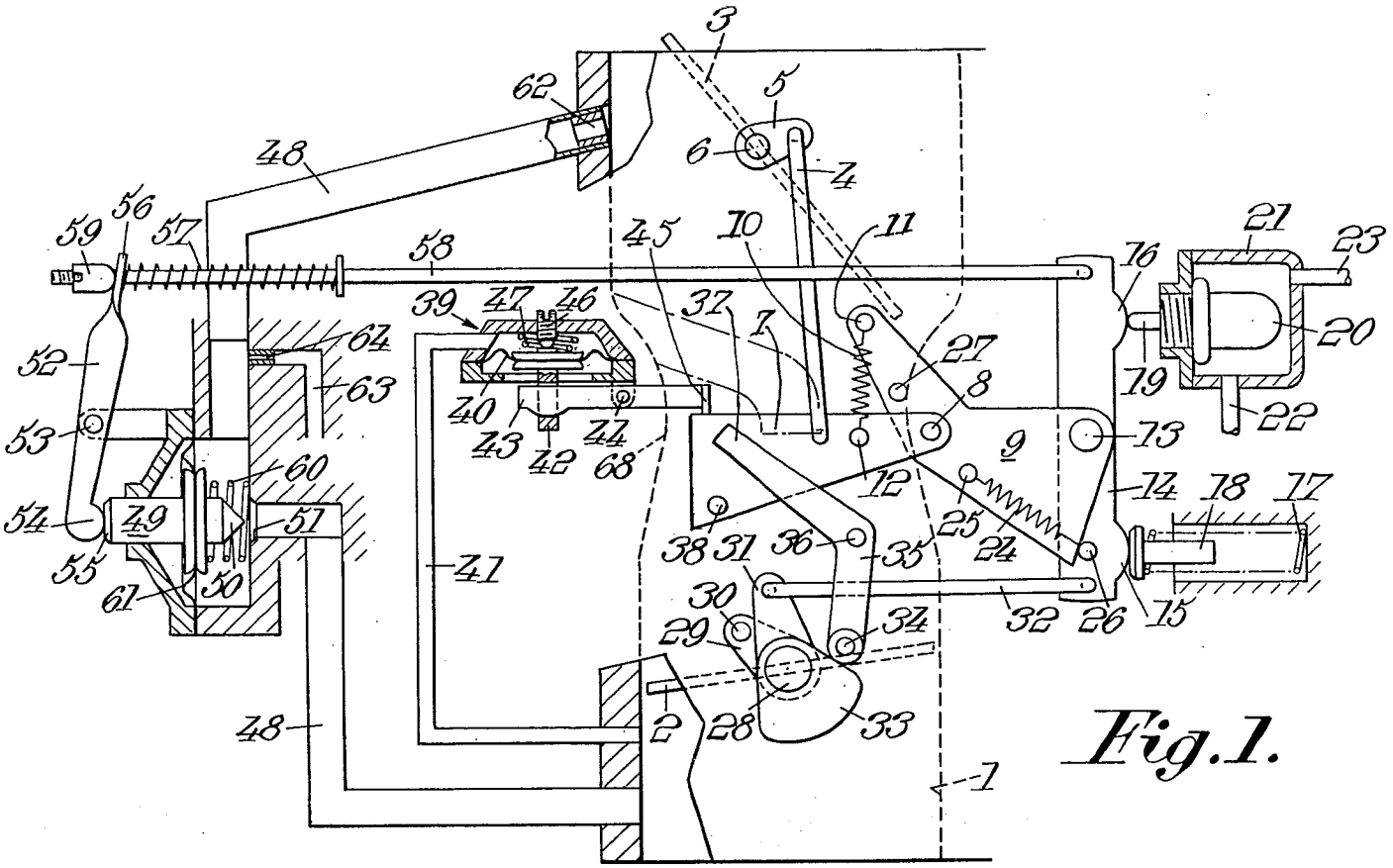

The invention relates to carburetor, for internal combustion engines, of the type which comprise, for the normal operation of these engines, a principal fuel jetting system which is situated upstream of a principal throttle member actuated by the operator and, for cold starting, an auxiliary starting device to increase the flow-rate of fuel and if necessary the flow- rate of air admitted into the intake pipe of the engine with respect to the corresponding flow-rate on hot running of the engine, said auxiliary starting device being controlled as a direct or indirect function of the temperature of the engine.

A first type of starting device is known which is constituted essentially by a starting or choke valve which is situated in the intake pipe upstream of the principal fuel jetting system. This valve is mounted on an eccentric axle so that it opens under the effect of the air flow which passes into said pipe, against the action of a return spring, and it has the effect of increasing the suction at the level of the abovesaid jetting system and, consequently, the richness of the air/fuel mixture admitted to the engine as long as the latter has not reached a minimum temperature.

Now regulations exist which are intended to limit atmospheric pollution and require that the flow-rates of air and fuel be more and more accurately metered especially when starting a warm engine, that is to say an engine whose temperature is at least of the order of 20°C but less than the normal operating temperature. In order that a warm engine may be started and rotated at low speed, the richness of the air/fuel mixture which it receives must be slightly increased with respect to the richness corresponding to the normal running temperature of the engine, It is difficult to determine this slight enrichment by means of the starting valve since a slight error in the angular position of this valve involves a large modification of the richness of the slow speed mixture, and this all the more as the flow-rate of air at slow speed is less.

A second type of starting device is known which is constituted essentially by a closure valve means adapted, as long as the engine has not reached its normal operating temperature, to open a passage which receives a mixture of air and of fuel in predetermined proportions and which opens into the zone of the intake pipe of the carburetor situated dowstream of its principal throttle member. It is known however that the enrichment of the mixture determined by a starting device of the second type diminishes when the load on the engine increases and that in particular it is difficult to obtain thus a sufficiently rich mixture for the operation at full load of an engine at very low temperature.

It is an object of the invention to provide carburetors which deliver a fuel air mixture whose richness of the mixture that they deliver is adapted to the temperature of the engines that they supply so that, the exhaust gases of these engines comply with the antipollution regulations in all circumstances.

To this end, the carburetor of the type concerned is characterized by the fact that its starting device comprises, on the one hand, a closure valve means adapted, as long as the engine has not reached its normal operating temperature, to open a passage which receives a mixture of air and of fuel in well determined proportions and which opens into the zone of the intake pipe situated downstream of its principal throttle member and, on the other hand, a starting valve situated in the intake pipe upstream of the principal jetting system, the starting valve being held sufficiently open, when the engine is warm, not to substantially enrich the air/fuel mixture on slow speed running and at very small engine loads.

In this way, when the engine is cold, the enrichment is determined both by the closure valve means and by the starting valve. When the engine is warm, the enrichment is determined essentially by the closure valve means. Finally, when the engine is at its normal operating temperature, both starting devices no longer act on the richness of the mixture.

Preferably, the starting valve is urged towards closing by elastic means which are biased by an element sensitive to the temperature of the engine, which element also controls the closure vlave means.

In a preferred embodiment, the starting valve is urged towards closing by elastic means which are biased by an element sensitive to the temperature of the engine and it is subject to means sensitive to the pressure existing in the intake pipe downstream of its principal throttle member to set for this member an intermediate minimal degree of opening as soon as the engine rotates by itself after starting, the latter means being influenced by the abovesaid element to increase the minimal degree of opening in proportion as the temperature of the engine increases.

The elastic return means of the starting valve can be constituted by a spring mounted between a first lever rotatable about a fixed axis and a second lever rotatable on an axle carried by the first lever, the return force exerted by said spring being transmitted to the starting valve through a link rod coupled to the second lever towards the center of the latter, while one of the ends of this second lever carries its abovesaid axle and its other end cooperates with stop means controlled by the above said pressure sensitive means, the angular position of the first lever being determined by the temperature-sensitive element. In this case, the temperature-sensitive element can act on the first lever through a third lever pivoted towards its center on the abovesaid fixed axle and cooperating by abutment with the first lever in the direction corresponding to cooling of said element and through a spring in the opposite direction. In addition, the third lever can control the closure valve means through a spring adapted to yield when the closure valve means is stopped in closed position and the temperature-sensitive element continues to be heated. Finally, the second lever can be connected to the principal throttle member through a unidirectional transmission mechanism which moves this second lever in the direction tending to increase the minimal degree of opening of the starting valve when the principal throttle member opens.

The invention will in any case be well understood by means of the additional description which follows and of the accompanying drawings, which description and drawings relate to a preferred embodiment of the invention, given of course purely by way of illustrative but non-limiting examples.

Figure 2:
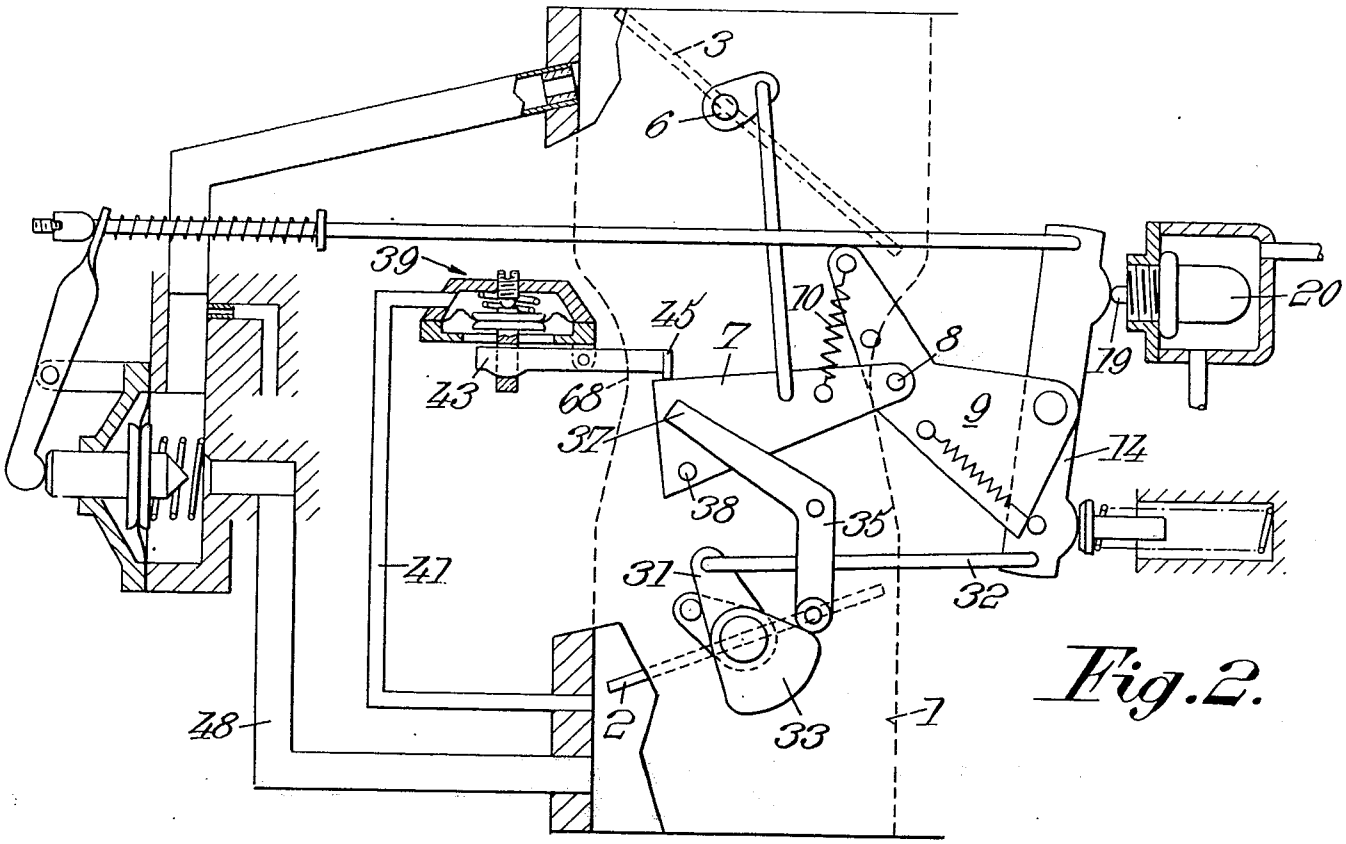
Figure 3:
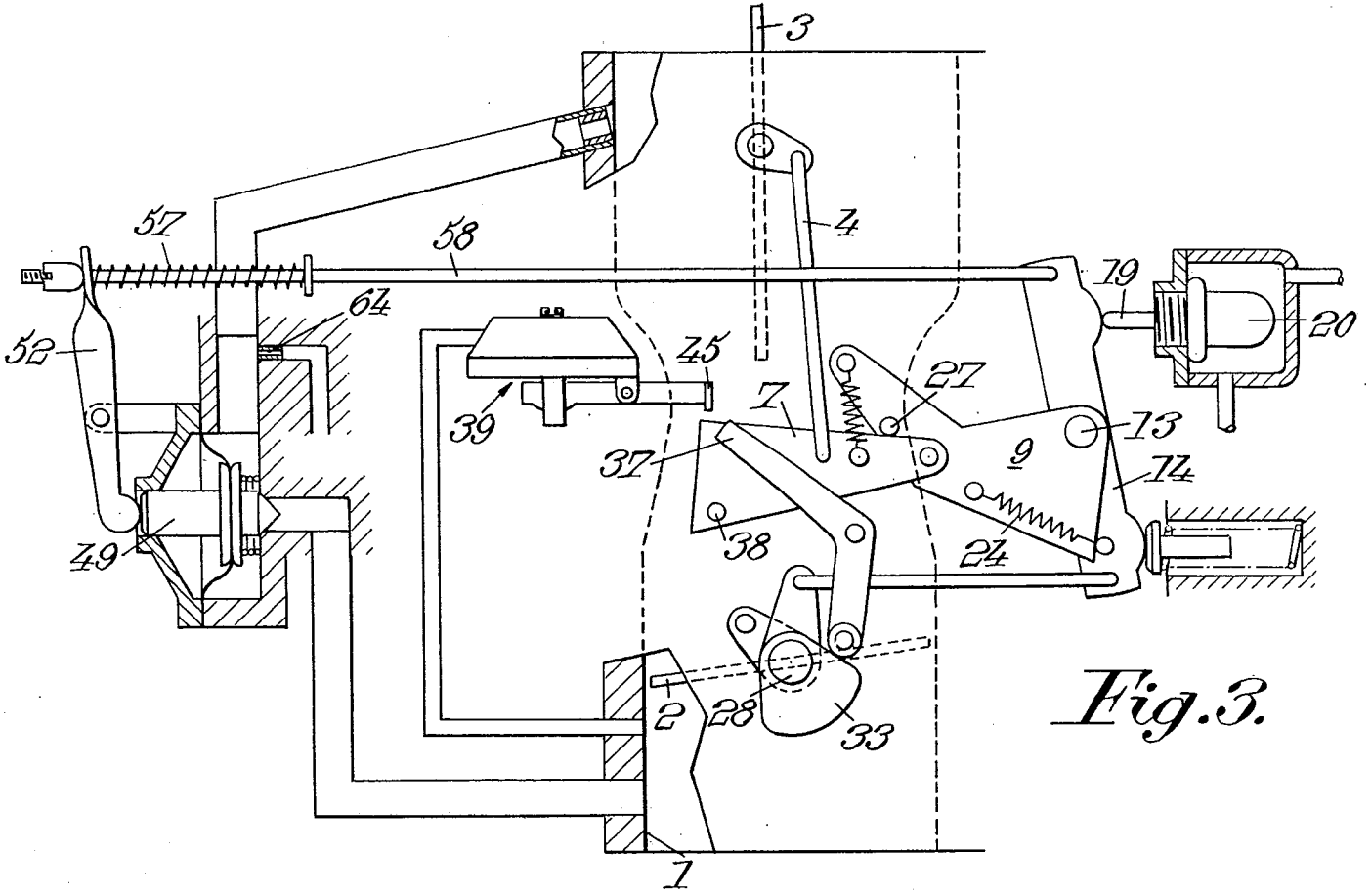

FIGS. 1 to 3 of these drawings show in diagrammatic elevation with parts cut away, one embodiment of a carburetor constructed according to the invention, of which the positions of its elements correspond to slow speed running, respectively, of a warm engine, of a cold engine and of a hot engine (that is an engine operating within its normal temperature range).

The carburetor comprises an intake pipe 1 in which is arranged, upstream of a principal throttle member (or butterfly valve) 2 under the control of the operator an eccentric starting valve 3 tending to open under the effect of the air flow in the pipe 1 against the effect of a return force transmitted through a link rod 4. This link rod connects a lever 5, fast to the axle 6 of the valve 3. A main fuel jetting system shown in broken lines in FIG. 1, opens into the pipe 1 between the principal throttle member and starting valve.

In the embodiment of FIGS. 1 to 3, the link rod 4 is coupled to a lever 7 pivoted on an axle 8 which is carried by a lever 9. The abovesaid return force is exerted by a spring 10 connected, through one end, to a pin 11 of the lever 9 and through the other end, to a pin 12 of the lever 7. The lever 9 is pivoted on an axle 13 which is fixed. On this axle 13 also pivots a lever 14 whose ends 15 and 16 are subject to opposing forces. On the one hand, a spring 17 thrusts through a push-rod 18 against the end 15 and on the other hand, the end 16 is in contact with the movable rod 19 of a temperature-sensitive element 20 of the type in which a material contained in a closed enclosure undergoes a variation in volume as a function of temperature, this variation in volume causing the movement of the rod 19. The element 20 is placed in a casing 21 wherein flows, between intake 22 and outlet 23 passages, a fluid whose temperature is representative of that of the engine.

The two levers 9 and 14 are made fast to one another, at least for certain positions of the lever 14, through a tension spring 24 fixed to pins 25 and 26, placed respectively on the levers 9 and 14. Moreover, the pin 26 serves as a stop for the lever 9. The pin 27 carried by the lever 9, cooperating with the upper section of the lever 7, enables the relative rotation of this latter lever to be limited with respect to the lever 9, around its axle 8.

The butterfly valve 2 comprises, besides the normal slow speed stop means (not shown), means for limiting its closing on cold operation. To constitute the latter means, there is fixed on the axle 28 of the butterfly valve 2, a lever 29 possessing a pin 30 which cooperates with the front face of the lever 31. The latter is mounted loosely on the axle 28 and is connected through link means 32 to the end 15 of the lever 14, so that the lever 31 serves as a slow speed stop variable with temperature.

On the axle 28 is fixed a cam 33 cooperating with a roller 34 carried by one of the ends of a lever 35, pivoting on a fixed axle 36, of which the other end 37 cooperates with a second pin 38 of the lever 7. When the butterfly valve 2 is open, the cam 33 causes the lever 35 to pivot in anticlockwise direction, so that the contact of the pin 38 with the end 37 of the lever 35 limits the closing of the valve 3.

A capsule 39 comprises a flexible diaphragm 40 subject on one side to the pressure existing in the pipe 1 downstream of the butterfly valve 2 through a passage 41 and on the other to the atmospheric pressure. This diaphragm 40 is connected to a rod 42 which acts on one of the ends of a lever 43 pivoted on a fixed axle 44. The other end 45 of the lever 43 cooperates with the upper section of the lever 7 to ensure a minimum opening of the valve 3, when the pressure downstream of the butterfly valve 2 is low. A screw 46 serving as a stop for the rod 42 enables the regulation of this minimum opening. A spring 47 opposes the force due to the difference in pressure exerted on the diaphragm 40.

The device which has just been described operates as follows.

When the engine is stopped cold, the rod 19 (see FIG. 2) is to a great extent inside the element 20, which gives the lever 14 a position such that the link means 32 and the lever 31 maintain the butterfly valve 2 sufficiently open for the engine to rotate at slow speed. Moreover, the spring 10 is tensioned and exerts a closing torque on the axle 6 of the valve 3, to increase the suction on the spray orifices of the jetting system (not shown) which open at the level of a venturi 68, between the butterfly valve 2 and the valve 3.

After starting of the cold engine, all the elements take up the position of FIG. 2. The pressure downstream of the butterfly valve 2 is low and it is transmitted through the passage 41 to the capsule 39 which actuates the lever 43, whose end 45 then thrusts on the lever 7 to impose a minimum opening on the valve 3.

If the butterfly valve 2 now opens, it will be seen that the valve 3 must be prevented from reclosing, which could occur at low speeds of the engine, since the flow-rate of air passing in the pipe 1 is insufficient to open the valve 3 in this case. The cam 33 causes the lever 35 to pivot in anticlockwise direction and the end 37 drives the lever 7 through the pin 38, thus ensuring a minimum opening of the valve 3 in the case of heavy loads.

It may be noted that the minimum opening positions of the valve 3, whether they are imposed by the capsule 39 or by the cam 33, depend on the temperature of the element 20. In fact, the axle 8 of the lever 7 moves with the lever 9 and it occupies a position which depends on the temperature. It follows that the position of the valve 3, which depends on the position of the two ends of the lever 7, depends in part on the temperature of the element 20.

The carburetor defined above is completed by an air passage 48, which connects the part of the pipe 1 situated doiwnstream of the butterfly valve 2 to the part of the pipe 1 situated upstream of the fuel spray orifices and downstream of the valve 3, when the latter is closed. This passage 48 can be opened or closed according to the position of a needle valve 49 whose conical end 50 cooperates with a seat 51 to close the passage 48.

This valve 49 is controlled by a lever 52 pivoting on an axle 53. One end 54 of the lever 52 cooperates with a part 55 of the valve 49 which forms a push-rod. The other end 56 of the lever 52 is thrust by a spring 57 mounted on a rod 58, which is pivoted on the end 16 of the lever 14.

A nut 59 adjusts the active length of the rod 58. A spring 60 tends to open the valve 49. A flexible diaphragm 61 ensures fluid-tightness. A calibrated orifice 62, mounted in the passage 48 upstream of the valve 49, limits the maximum flow-rate of air passing into this passage. A fuel passage 63, connected to a float chamber (not shown), opens through a calibrated orifice 64 into the part of the channel 48 situated upstream of the valve 49 and downstream of the calibrated orifice 62.

The device described with reference to FIGS. 1 to 3 operates in the following way:

When the engine is warm, that is to say when its temperature is above the temperature limit in the neighborhood of 20°C and below that corresponding to normal operation, the position of the elements is that which is shown in FIG. 1. In particular, the position of the lever 14 is such that the lever 52 enables the valve 49 to be opened under the effect of the spring 60. Moreover, the position of the butterfly valve 2 only depends on the normal slow speed stop (not shown), since the lever 31, driven by the link means 32, is no longer in contact with the pin 30.

When the engine is driven by the starter, the valve 3 is closed and ensures the necessary enrichment on starting. Immediately after starting, the capsule 39 holds the valve 3 more or less open. It has been seen that the degree of opening is a function of the temperature and the assembly is arranged so that the valve 3 is sufficiently open in order that, at slow speed and at very low loads, no enrichment of the carburetted mixture is produced.

In this case, the additional air admitted to the engine is determined by the calibrated orifice 62 and the fuel which passes through the calibrated orifice 64 can be metered with high accuracy. The air-fuel mixture supplied to the engine can even have a richness slightly below that of the mixture of a hot engine at slow speed, as is sometimes necessary to meet atmospheric pollution regulations.

At full load, of course the influence of the flow-rate passing in the passage 48 becomes negligible relative to the flow-rate passing in the intake pipe 1, but the valve 3, which tends to be closed by the spring 10, enables the necessary enrichment for the operation under load of the engine to be ensured.

When the engine is hot, the various elements occupy positions shown in FIG. 3.

Under the effect of the displacement of the rod 19 towards the left of the Figures, the lever 14 and consequently the lever 9 rotate about the axle 13 in anticlockwise direction. The pin 27 drives the lever 7 which, by acting on the link rod 4, opens the valve 3.

Simultaneously, the rod 58 pushes the lever 52 which closes the valve 49.

If, for any reason, the temperature of the element 20 continues to increase, the rod 19 must be left free to move lest the element 20 become damaged. This is the role of the springs 57 and 24 which enable the lever 14 to pivot beyond the position corresponding to the hot engine, although the valve 3 may already be out of action.

There is thus obtained a device for starting and cold operation which uses, under all conditions, the closure valve means and the starting valve, except on the slow speed operation of a warm engine. In the latter case, the starting valve is without effect on the richness of the air-fuel mixture, which is determined by the calibrated orifices 62 for air and 64 for fuel of the system controlled by the closure valve means.

I claim:

1. Carburetor for an internal combustion engine, comprising:

an intake pipe;

an operator actuatable main throttle member in said pipe;

a main fuel jetting system which opens into said pipe upstream of said throttle member for providing fuel to the engine during operation thereof under load;

and an auxiliary cold starting and warm-up device responsive to the temperature of the engine to increase the flow rates of fuel and air delivered to the intake pipe, said auxiliary device including:

an unbalanced startng valve located in the intake pipe upstream of the outlet of said main fuel jetting system into said pipe;

resilient return means urging the starting valve towards its closed position and exerting a force which decreases in proportion to engine temperature as the temperature of the engine increases;

a passage which opens into said intake pipe downstream of the main throttle member;

closure valve means in said passage;

means for delivering a mixture of air from a zone of said intake pipe downstream of the starting valve and of fuel, having a predetermined richness, to said passage upstream of said closure valve means;

means responsive to the temperature of the engine and operatively connected to said closure valve means for closing said closure valve means when heated to a predetermined temperature; and means responsive to the pressure existing in the intake pipe downstream of the main throttle member and limiting closure of said starting valve at small engine load whereby the air-fuel mixture is prevented from being substantially enriched, wherein said limiting means are sensitive to pressure existing in the intake pipe downstream of the main throttle member to prevent said starting valve from closing beyond an intermediate degree of opening as soon as the engine is self running after starting, said pressure sensitive means cooperating with said temperature responsive means, whereby the minimal degree of opening is increased in proportion to engine temperature as the temperature of the engine increases; and wherein said resilient means are constituted by a first spring mounted between a first lever rotatable about a fixed axis and a second lever rotatable on an axle carried by the first lever, the return force exerted by said first spring being transmitted to the starting valve through a link rod coupled to the second lever towards the center of the second lever, while one of the ends of the second lever carries the abovementioned axle and the other end cooperates with stop means controlled by said pressure sensitive means, the angular position of the first lever being determined by the temperature responsive means.

2. Carburetor according to claim 1 wherein the temperature responsive means acts on the first lever through a third lever pivoted towards its center on said fixed axis and cooperating by abutment with the first lever in the direction corresponding to cooling of said temperature responsive means and through a second spring in the opposite direction.

3. Carburetor according to claim 2 wherein the third lever controls the closure valve means through a third spring adapted to yield when the closure valve means is stopped in a closed position and the temperature of the temperature responsive means continues to rise.

4. Carburetor according to claim 1 wherein the second lever is connected to the main throttle member through a unidirectional transmission mechanism which moves this second lever in the direction tending to increase the minimum degree of opening of the starting valve when the main throttle member opens.

5. Carburetor according to claim 2 wherein the third lever controls a stop limiting the minimal degree of opening of the main throttle member.

* * * * *